US005096529A

United States Patent [19]

Baker

[11] Patent Number: 5,096,529

[45] Date of Patent: Mar. 17, 1992

[54] ADJUSTABLE SEAT ASSEMBLY BLADDER SEALING METHOD

[76] Inventor: Robert A. Baker, Rte. 1, Lakeview Dr., Dandridge, Tenn. 37725

[21] Appl. No.: 678,754

[22] Filed: Apr. 1, 1991

Related U.S. Application Data

[63] Continuation of Ser. No. 341,912, Apr. 24, 1989, abandoned.

[51] Int. Cl.[5] ..... B32B 3/04

[52] U.S. Cl. ..... 156/216; 156/290; 156/292; 156/309.6

[58] Field of Search ..... 156/216, 290, 292, 293, 156/309.6; 5/441, 449, 455; 297/DIG. 3, DIG. 8; 428/12, 35.4, 63, 250, 252

[56] References Cited

U.S. PATENT DOCUMENTS

| | | | |
|---|---|---|---|
| 3,738,903 | 6/1973 | Berwick et al. | 156/293 |
| 3,925,835 | 12/1975 | Pennington et al. | 5/455 |
| 4,238,263 | 12/1980 | LoMaglio | 156/216 |
| 4,255,824 | 3/1981 | Pertchik | 297/DIG. 3 |
| 4,302,270 | 11/1981 | Nicolet | 156/290 |
| 4,504,989 | 3/1985 | Maltz | 5/455 |
| 4,555,140 | 11/1985 | Nemoto . | |
| 4,629,253 | 12/1986 | Williams . | |
| 4,720,146 | 1/1988 | Mawbey et al. . | |
| 4,775,185 | 10/1988 | Scholin et al. . | |

*Primary Examiner*—Joye L. Woodard
*Attorney, Agent, or Firm*—Pitts and Brittian

[57] ABSTRACT

An adjustable seat assembly bladder for altering the surface contour of a seat and an associated bladder sealing method is provided. The seat assembly bladder comprises a pair of inflatable chambers, each having inner and outer chamber walls. At least a portion of the inner walls of the chambers are joined and an opening is provided at a point at which such walls are joined to establish fluid communications between the chambers. The walls of the chambers are fabricated from a laminated material having a plurality of layers, and air or gas is prevented from escaping through the laminated inner walls by sealing selected edge portions of the inner walls. The sealing process of the present invention by which the layers of the inner walls are sealed includes applying heat to one or more fusible or moldable washers to produce a seal covering selected edges of the inner walls, or, alternatively, applying heat directly to selected edge portions of the inner walls to fuse the layers comprising the inner walls together.

9 Claims, 4 Drawing Sheets

ADJUSTABLE SEAT ASSEMBLY BLADDER SEALING METHOD

This application is a continuation, of application Ser. No. 07/341,912, filed Apr. 24, 1989 now abandoned.

TECHNICAL FIELD

This invention relates to an inflatable seat assembly bladder for positioning in a seat to allow the selective altering of the surface contours of such seat and an associated sealing method. In this particular invention the bladder includes two inflatable chambers joined together and placed in fluid communication with an opening at a point where the chambers are joined.

BACKGROUND ART

It is known in the art to place inflatable bladders in seats, such as automobile seats, and various seat components, such as head rests, for adjustably altering the surface contours of the seats in accordance with individual preferences. Of course, the change in surface contour is accomplished by selectively inflating one or more such bladders with air or other suitable gas. Typically such seat bladders comprise two, or more inflatable chambers, each chamber being defined by an inner and outer wall. The inner and outer walls of each chamber are secured together with adhesive or with a heat sealing process which secures the inner surfaces of the walls together, but leaves the perimeter edges of the walls unsealed and exposed. The chambers are joined by securing selected portions of their respective inner walls together utilizing an adhesive or heat sealing method. At a point where the inner walls are joined an opening is provided to establish fluid communications between the chambers and the wall edges circumscribing the opening are unsealed and exposed. Further, the preferred fabrication material for fabricating the inner and outer walls is a laminate, including a web or fabric layer sandwiched between layers of a plastic material. Typically the fabric layer is a synthetic or natural fiber and the plastic layers are made from polyetherurethane or other heat sealable material. This laminated material is favored because it is suitably flexable to allow inflation, and yet strong and durable. However, it has been found that when a bladder is inflated there is a tendency for air or gas to escape from the bladder by entering the thread paths of the fabric layer of the inner walls at the exposed edges circumscribing the opening between chambers and exiting the bladder via the exposed perimeter edges of the inner walls. Thus, over a period of time the bladder deflates and must be reinflated if the desired seat contour is to be re-established.

Therefore, it is an object of the present invention to provide an adjustable seat assembly bladder which is sealed to prevent loss of air or gas from the bladder through the laminated chamber walls, and to provide a method for accomplishing such sealing of the bladder.

It is a further object of the present invention to provide an adjustable seat assembly bladder sealing method which is inexpensive to practice and a seat bladder which does not require periodic reinflation to maintain the desired seat contours.

DISCLOSURE OF THE INVENTION

Other objects and advantages will be accomplished by the present invention which provides an adjustable seat bladder and associated bladder sealing method. The seat bladder comprises at least first and second inflatable chambers for being selectively inflated with a gas, each chamber having an outer chamber wall and an inner chamber wall. At least a portion of the inner chamber walls of the chambers are secured together so as to join the chambers, and at least one opening is provided which extends through the inner walls at a point where the inner walls are joined for establishing fluid communications between the first and second chambers, the inner walls defining a circumferential edge about the opening. The inner and outer walls of each chamber are fabricated of a laminated material and in order to prevent gas from escaping through the layers of the laminate selected portions of the edges of the inner walls are sealed. In this regard, in one embodiment a seal is provided over the circumferential edge defining the opening between chambers to prevent gas from entering the inner walls, and in another embodiment a seal is provided over the outer perimeter edge of the inner walls to prevent gas from escaping the inner walls.

The sealing process of the present invention by which the layers of the inner walls are sealed generally comprises the application of heat to one or more fusible or moldable washers to produce a seal covering either the circumferential edge defining the opening between chambers or the perimeter edge of the inner walls. In an alternative application of the process heat is applied directly to the circumferential edge of the opening fusing the layers of the laminate material to produce a seal, or heat is applied directly to the perimeter edges of the inner walls to produce a seal.

DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
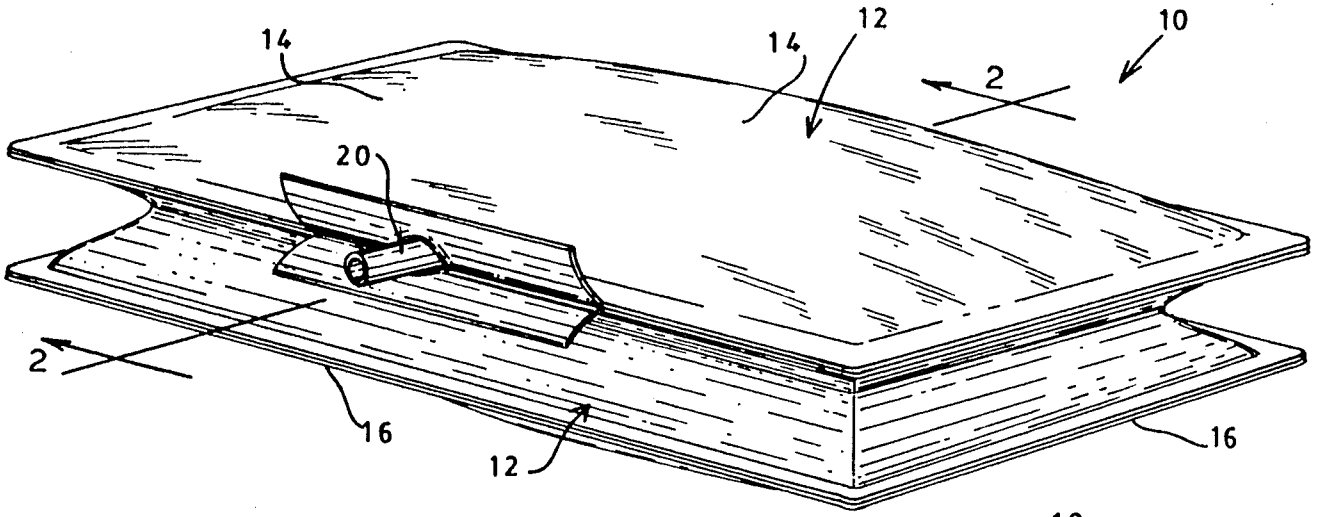
FIG. 1 illustrates a perspective view of an adjustable seat assembly bladder of the present invention.
Figure 2:
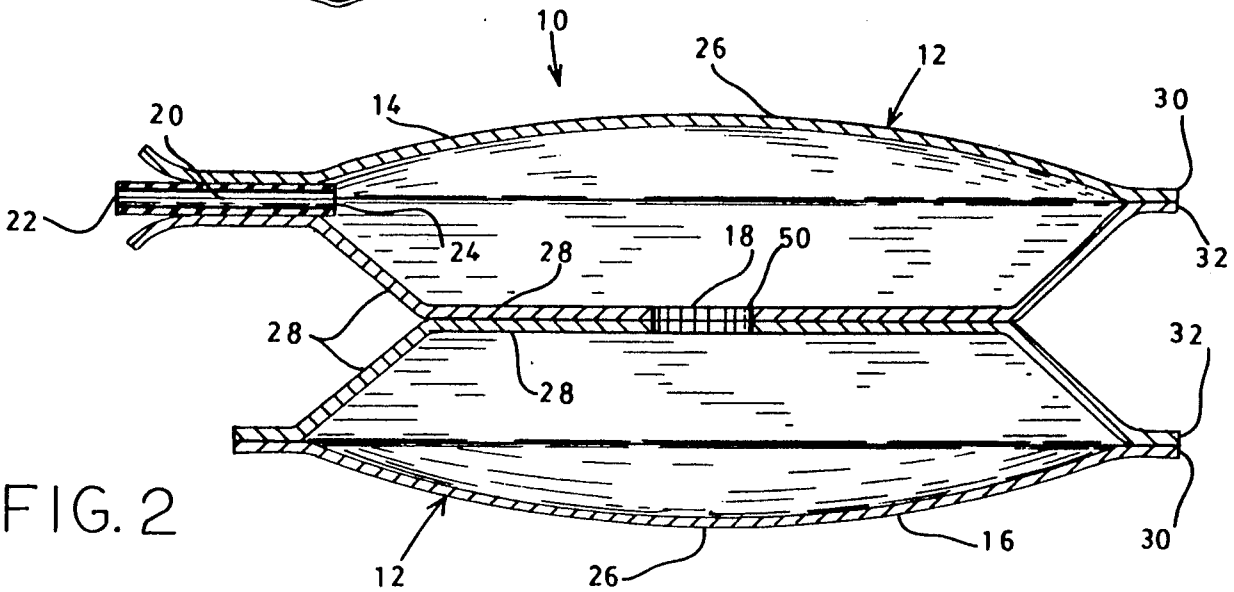
FIG. 2 illustrates a side elevation view, in section at 2—2 of FIG. 1, of an adjustable seat assembly bladder of the present invention.

An adjustable seat assembly bladder incorporating various features of the present invention is illustrated generally at 10 in FIGS. 1 and 2. The bladder 10 comprises a body 12 having two or more inflatable chambers so as to define a bellows configuration. In this regard, it will be recognized that for certain applications the bladder can have five or more chambers. In the preferred illustrated embodiment the bladder 10 includes two such inflatable chambers 14 and 16 which are joined together, with at least one opening 18 being provided at a point where the chambers are joined to establish fluid communications between the chambers 14 and 16. Means are also provided for connecting the chamber 14 to a pump or other source of pressurized air or gas, such as the illustrated supply tube 20. As illustrated, the tube 20 has a first end portion 22 which is exterior to the chamber 14 for connecting to a pump or other supply means, and a second end portion 24 which extends into the chamber 14 so as to communicate with the volume defined therein.

It will be recognized that as air or other gas is forced into the chamber 14 through the tube 20 both the chamber 14 and the chamber 16 inflate due to the fluid communication established by the opening 18. Accordingly, when the bladder 10 is positioned in a seat (not shown) the seat surface adjacent or proximate the bladder 10 can be made to expand outwardly by selectively inflating the bladder 10, or can be made to contract by selectively deflating the bladder 10, thereby allowing the surface contours of the seat to be altered.

More specifically with respect to the construction of the bladder 10, in the preferred embodiment each of the chambers 14 and 16 includes an outer chamber wall 26 and an inner chamber wall 28 secured together at their perimeters 30 and 32, respectively, as with an adhesive or a heat actuated sealing process. Further, selected portions of the inner walls 28 of the chamber are secured together, with the opening 18 extending through both inner walls 28. As will be discussed further with respect to FIGS. 4A-C, the walls 26 and 28 are preferably fabricated of a web or fabric 34, such as a polyester fabric, sandwiched between two sheets of a flexible plastic 36 and 38, such as polyetherurethane or other heat sealable material, to form a fluid impervious, flexible laminate.

Figure 3:
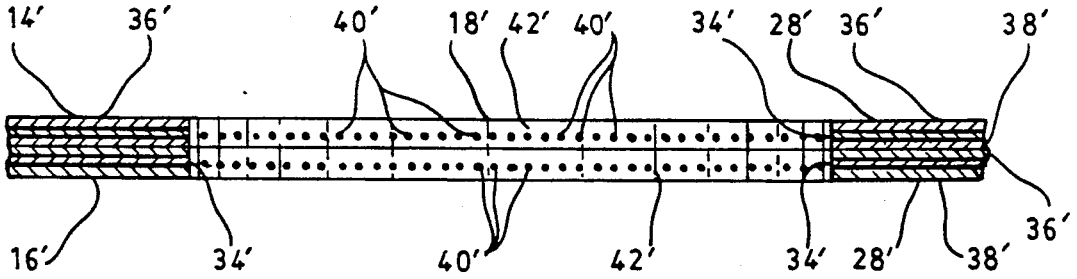
FIG.3 (PRIOR ART)
FIG. 3 illustrates a partial side elevation view, in section, of a prior art seat bladder.

In FIG. 3 a portion of a prior art bladder is illustrated, with features equivalent to the features of the bladder 10 referenced by common prime numerals. The portion illustrated in FIG. 3 is at the point where the inner walls 28' of the chambers are joined and proximate the location of the opening 18'. It will be noted that following conventional construction methods the opening 18' has been simply cut through the walls 28' leaving the thread ends 40' of the fabric 34' exposed about the perimeter of the opening 18'. As a consequence, air or gas within the chambers of the bladder is allowed to escape along the thread paths defined in the laminated inner wall and exit the bladder along the outer perimeter of the inner walls. Thus, over a period of time the bladder deflates, thereby altering the contours of associated seat. To obviate this problem the edges 42 of the inner walls 28 of the bladder 10 which define the opening 18 are sealed in accordance with the sealing method of the present invention.

Figure 4A:
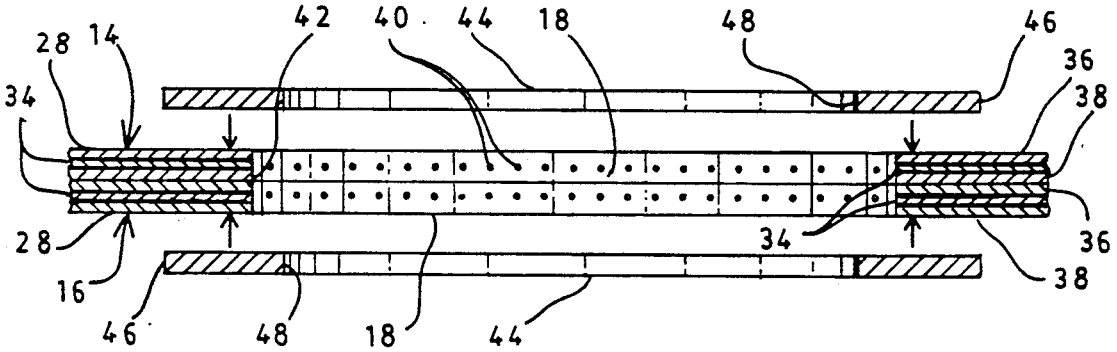
FIGS. 4A–C illustrate partial side elevation views, in section, of adjustable seat assembly bladders of the present invention.
Figure 4B:
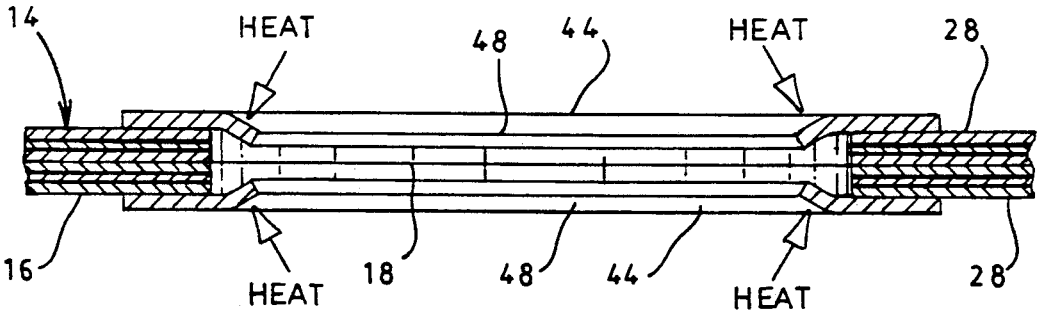
Figure 4C:
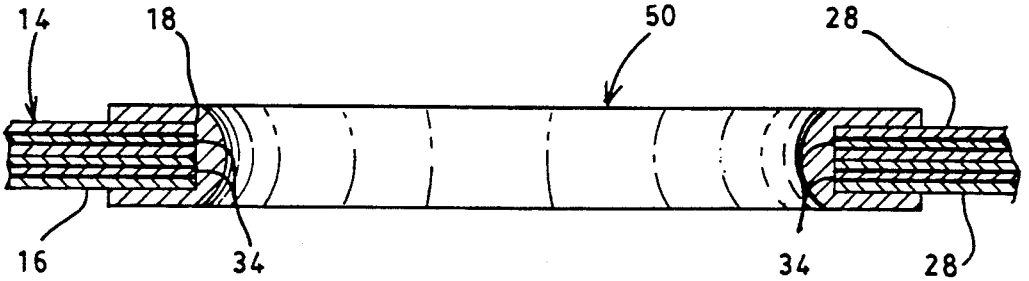

Referring now to FIG. 4A, in the preferred application of the bladder sealing process of the present invention a moldable washer 44 is placed on either side of the joined inner walls 28, the washers 44 preferably being fabricated of a fusible plastic. As illustrated each washer 44 defines an outer perimeter 46 defining a diameter greater than the opening 18 and an inner perimeter 48 defining a diameter smaller than the opening 18. As illustrated in FIG. 4B heat is then applied to the washers 44 and the portion of the washers 44 proximate their inner perimeters 48 is forced, through use of suitable actuating means, inwardly into the opening 18. As the inner perimeters 48 of the washers 44 meet the heat applied causes the moldable plastic to fuse creating a seal 50 which seals the edges of the opening 18 and, thus, the thread ends 40', as illustrated in FIG. 4C.

Figure 5:
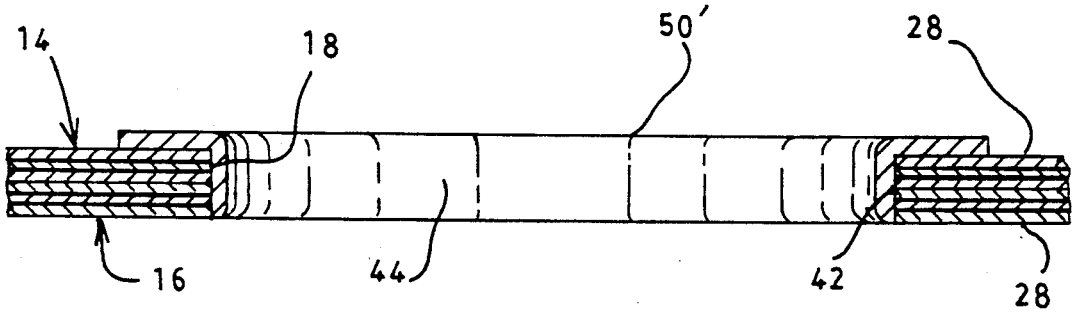
FIG. 5 illustrates a partial sided elevation view, in section, of an adjustable seat assembly bladder of the present invention.
Figure 6:
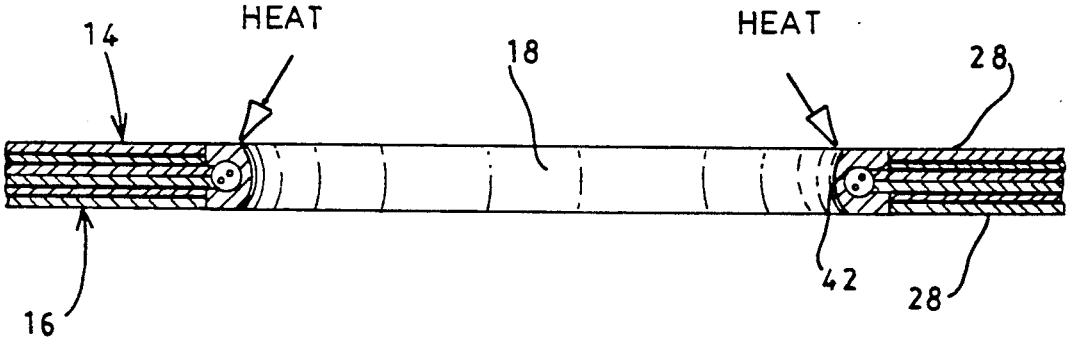
FIG. 6 illustrates a partial sided elevation view, in section, of an adjustable seat assembly bladder of the present invention.

As illustrated in FIG. 5, a single washer 44 can be utilized to seal the edges of the opening 18 if desired. In this regard, the portion of the washer 44 proximate the inner perimeter 48 is heated and forced into the opening 18 and against the edges defining the opening 18, thereby creating the seal 50'. It will be recognized, however, that the u-shaped cross section of the seal 50 is preferred. A further alternate sealing method for sealing the edges defining the opening 18 is illustrated in FIG. 6. In accordance with this method heat is applied to the edges of the opening causing the plastic sheets 36 and 38 and the fabric 34 to fuse and seal the edges of the opening 18.

Figure 7:
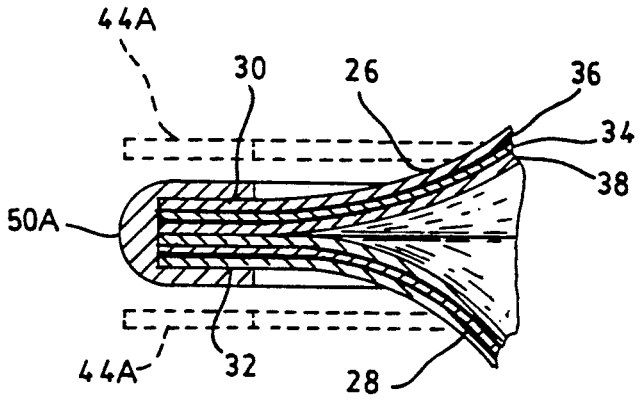
FIG. 7 illustrates a partial sided elevation view, in section, of an adjustable seat assembly bladder of the present invention.
Figure 8:
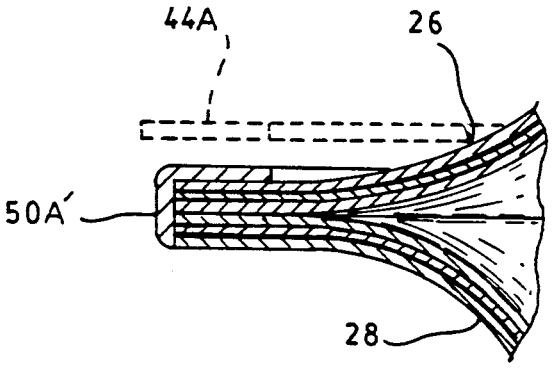
FIG. 8 illustrates a partial sided elevation view, in section, of an adjustable seat assembly bladder of the present invention.
Figure 9:
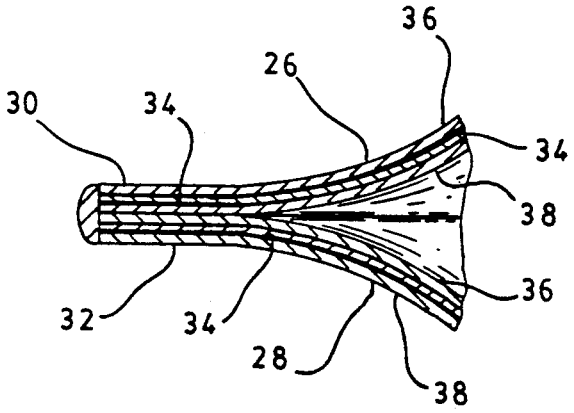
FIG. 9 illustrates a partial sided elevation view, in section, of an adjustable seat assembly bladder of the present invention.

As indicated above, air or gas entering the thread pathways of the walls 26 and 28 escapes the bladder 10' at the perimeters 30 and 32 of the walls 26 and 28, respectively. Accordingly, an alternative bladder sealing method of the present invention involves sealing the perimeters 30 and 32. As illustrated in FIG. 7, in the preferred application of this alternate method a pair of washers 44A, configured to engage the walls 26 and 28 proximate their respective perimeters, are fused, as discussed above with respect to the washers 44, about each chamber to create a seal 50A which seals the perimeters 30 and 32 of each chamber preventing air or gas from escaping. As with the sealing of the edges of the opening 18 this sealing can also be accomplished by utilizing one washer 44A, as illustrated in FIG. 8, or by fusing the layers 36 38 and the fabric 34 at the perimeters 30 and 32 by applying heat, as illustrated in FIG. 9.

In light of the above, it will be recognized that the adjustable seat assembly bladder and associated sealing method of the present invention provide great advantages over the prior art. In this regard, the loss of air or gas pressure within the bladder through the thread paths of the laminated bladder walls is prohibited, and periodic reinflation of the bladder to re-establish the desired seat contour is obviated. Moreover, the sealing process of the present invention adds very little to the cost of construction of the bladder.

While a preferred embodiment of the bladder of the present invention, and a preferred application of the sealing method of the present invention, has been shown and described, it will be understood that there is no intent to limit the invention to such disclosure, but rather it is intended to cover all modifications and alternate constructions falling within the spirit and scope of the invention as defined in the appended claims.

I claim:

1. A sealing method for prohibiting gas leakage from a seat assembly bladder, said seat assembly bladder including at least a first and second inflatable chamber for being selectively inflated with a gas, each said chamber having an outer wall and an inner wall, at least a selected portion of said inner walls of said first and second chambers being joined to each other, said bladder being provided with at least one opening extending through said inner walls of said chambers at said portion where said inner walls are joined for establishing fluid communication between said first and second chambers, said inner walls defining a circumferential edge defining said opening, said inner walls being fabricated of a laminated material including a plurality of layers, at least one of said layers being a fabric layer containing threads whereby thread ends are exposed at said circumferential edge of said opening, said sealing method comprising the steps of:

placing a fusible washer in contact with one of said inner walls so as to be in substantially coaxial alignment with said opening, said washer having an outer perimeter defining a circumference greater than said opening and an inner perimeter defining a circumference smaller than said opening;

applying heat to said fusible washer; and during application of said heat, bending said inner perimeter of said washer into said opening to overlay said thread ends thereby fusing said washer with said circumferential edge whereby a seal is created covering said circumferential edge to prevent gas from escaping along said threads in said inner walls.

2. The method of claim 1 further comprising the steps of:

placing a second fusible washer in contact with the other of said inner walls so as to be in substantially coaxial alignment with said opening, said second washer having an outer perimeter defining a circumference greater than said opening and an inner perimeter defining a circumference smaller than said opening;

applying heat to said second washer; and during the application of said heat, bending said inner perimeter of said second washer into said opening and into contact with said circumferential edge whereby said heat causes said inner perimeters of said washer and second washer to fuse together creating a seal covering said circumferential edge.

3. The method of claim 2 wherein said washer and said second washer are fabricated from a plastic.

4. The method of claim 1 wherein said washer is fabricated from a plastic.

5. The sealing method of claim 1 wherein each said inner wall of said first and second chambers defines an outer perimeter edge having exposed thread ends, said method further comprising the steps:

placing a further fusible washer into contact with one surface of each of said inner walls of each said first and second chambers, each said further washer having an inner portion for overlaying said inner wall proximate said perimeter edge of said inner walls and an outer portion for overhanging said perimeter edge;

applying heat to each said further washer; and during application of said heat, bending said outer portion of each said further washer over said perimeter edge, including said thread ends, of each said inner walls of said first and second chambers whereby a seal is created covering said perimeter edge of each said inner walls to prevent loss of said gas from said chambers along said threads.

6. The sealing method of claim 5 further comprising the steps of:

placing a second further fusible washer into contact with each outer wall of each said first and second chamber, each said second further washer having an inner portion for overlaying said outer wall operatively associated therewith proximate said chamber walls perimeter edge and an outer portion for overhanging said perimeter edge;

applying heat to each said second further washer; and during the application of said heat, bending said outer portion of each said second further washer over said perimeter edges of said outer wall operatively associated therewith whereby said heat causes said outer portions of said further and second further washers to fuse together creating a seal covering said perimeter edges of each said inner walls for preventing leakage of said gas along said threads of said inner walls.

7. The method of claim 6 wherein said further and second further washers are fabricated from plastic.

8. The method of claim 5 wherein said further washer is fabricated from a plastic.

9. A sealing method for prohibiting gas leakage from a seat assembly bladder, said seat assembly bladder including at least a first and second inflatable chamber for being selectively inflated with a gas, each said chamber having an outer wall and an inner wall, at least a selected portion of said inner chamber walls of said first and second chambers being joined, said bladder being provided with at least one opening extending through said inner walls of said chambers at said portion where said inner walls are joined for establishing fluid communications between said first and second chambers, said inner walls defining a circumferential edge defining said opening, said inner walls being fabricated of a laminated material including a fabric layer fabricated from threads disposed between first and second outer layers fabricated from a plastic whereby said threads define thread pathways in said inner walls, said sealing method comprising the steps of:

placing a first plastic washer in contract with said inner wall of said first chamber so as to be in substantially coaxial alignment with said opening, and placing a second plastic washer in contact with said inner wall of said second chamber so as to be in substantially coaxial alignment with said opening, each said first and second washer having an outer perimeter defining a circumference greater than said opening and an inner perimeter defining a circumference smaller than said opening;

applying heat to said washers; and during the application of said heat, bending said inner perimeters of said first and second washers into said opening and into contact with said circumferential edge whereby said heat causes said inner perimeters of said first and second washers to fuse together creating a seal covering said circumferential edge such that said gas cannot escape said bladder through said thread pathways of said inner walls.

* * * * *